United States Patent [19]

Palilla et al.

[11] Patent Number: 4,538,347

[45] Date of Patent: Sep. 3, 1985

[54] METHOD FOR MAKING A VARISTOR PACKAGE

[75] Inventors: Frank C. Palilla, Framingham, Mass.; Burton W. MacAllister, Jr., Hudson, N.H.; Caster Salemi, Medfield, Mass.

[73] Assignee: GTE Laboratories Incorporated, Waltham, Mass.

[21] Appl. No.: 621,353

[22] Filed: Jun. 18, 1984

[51] Int. Cl.[3] ..... H01C 7/12; H01C 17/30

[52] U.S. Cl. ..... 29/619; 29/621; 264/61; 264/62; 264/340; 264/344; 264/233; 264/104; 264/272.18; 264/265; 156/625; 156/667; 427/103; 427/423

[58] Field of Search ..... 338/21; 357/10; 156/667, 625; 264/61, 62, 340, 344, 233, 104, 272.18, 265; 29/621, 619; 134/28; 427/101, 102, 103, 309, 423

[56] References Cited

U.S. PATENT DOCUMENTS

| | | | |
|---|---|---|---|
| 3,296,012 | 1/1967 | Stalneck | 427/309 |
| 3,574,570 | 4/1971 | Gwyn | 428/650 |
| 3,689,863 | 9/1972 | Matsuoka et al. | 357/10 |
| 3,764,566 | 10/1973 | Matsuoka et al. | 338/21 |
| 3,811,103 | 5/1974 | Matsuoka et al. | 338/21 |
| 3,903,494 | 9/1975 | May | 338/21 |
| 4,103,274 | 7/1978 | Burgess et al. | 338/21 |
| 4,135,012 | 1/1979 | Su | 427/309 |
| 4,165,351 | 8/1979 | May | 264/61 |
| 4,189,084 | 2/1980 | Johnson et al. | 357/10 |
| 4,318,770 | 3/1982 | Chakupurakal | 427/309 |
| 4,377,541 | 3/1983 | Bobik | 264/61 |
| 4,433,264 | 2/1984 | Nishiyama et al. | 310/321 |
| 4,441,094 | 4/1984 | Levinson | 338/21 |
| 4,444,351 | 4/1984 | Dries | 228/121 |
| 4,445,066 | 4/1984 | Nishiyama et al. | 310/321 |

FOREIGN PATENT DOCUMENTS 1551319 8/1979 United Kingdom .

*Primary Examiner*—Richard Bueker
*Attorney, Agent, or Firm*—Ivan L. Ericson

[57] ABSTRACT

A process for making an encapsulated metal oxide varistor package comprises pressing the varistor powder mixture into a disc, sintering the pressed disc, followed by slow cooling to room temperature.

The sintered disc is acid etched and a fritted-silver electrode applied on each side of the disc or in the alternative an aluminum coating is arc sprayed on each side of the disk followed by an arc sprayed copper coating on top of the aluminum coating. The fritted-silver electrode coating is heated to 660° C. and slow cooled to room temperature. Sn-coated copper leads are soldered on the electroded disc of either electrode process and the assembly is encapsulated in resilient epoxy resin to form the encapsulated metal oxide varistor package.

2 Claims, 4 Drawing Figures

METHOD FOR MAKING A VARISTOR PACKAGE

FIELD OF THE INVENTION

This invention relates to a method of making a varistor package. More particularly, this invention relates to a method of making a zinc oxide varistor package for voltage surge suppression applications.

BACKGROUND OF THE INVENTION

A varistor is an electrical component in which the current increases markedly as the voltage applied across the device increases. This characteristic makes the device suitable for applications such as protection against overvoltage surges in electrical circuits. Several types of surge suppressors are available, including:

Zener or avalanche diodes which are effective in clamping transients to low voltages but are costly to fabricate for high surge energy applications.

Metal oxide varistors based on zinc oxide or other metal oxides and fabricated by ceramic processing techniques. These devices are inexpensive to fabricate but operate best at high voltages and are difficult to adapt for low voltage (3 to 30 V) applications.

Various voltage-dependent resistors have been widely used for stabilization of voltage of electrical circuits or suppression of abnormally high voltage surges induced in electrical circuits. The electrical characteristics of such voltage-dependent resistors are expressed by the relation:

$$I=(V/C)^n$$

where V is the voltage across the resistor, I is the current flowing through the resistor, C is a constant corresponding to the voltage at a given current and exponent n is a numerical value greater than 1. The value of n is calculated by the following equation:

$$n=[\log_{10}(I_2/I_1)]/[\log_{10}(V_2/V_1)]$$

where $V_1$ and $V_2$ are the voltages at given currents $I_1$ and $I_2$, respectively. The desired value of C depends upon the kind of application to which the resistor is to be put. It is ordinarily desirable that the value of n be as large as possible since this exponent determines the extent to which the resistors depart from ohmic characteristics.

Metal oxide varistors are usually manufactured by mixing a plurality of additives with a powdered metal oxide, commonly zinc oxide. Typically, four to twelve additives are employed. The metal oxide and additive mixture is then pressed into a body of a desired shape and size. The body is then sintered for an appropriate time at a suitable temperature as is well known in the prior art. Sintering causes the necessary reactions among the additives and the metal oxide and fuses the mixture into a coherent pellet. A passivating coating is sometimes applied to the sintered body. If a coating is applied, the body with the coating is generally reheated. Next, metallic contacts are applied to the body. The contacts can, for example, be applied by techniques such as the application of a silver paste or by metallic flame spraying.

A problem encountered in metal oxide varistors manufactured by the prior art method has been contact failure. Occasionally a contact will develop a crack or tear near the lead attachment or will peel from the varistor body entirely. Either of these events can, of course, lead to device failure. This has become a matter of concern to varistor manufacturers.

For a better understanding of the present invention, together with other and further objects, advantages and capabilities thereof, reference is made to the following disclosure and appended claims in connection with the above-described drawing.

SUMMARY OF THE INVENTION

In accordance with the present invention, a new and improved method for making a metal oxide varistor package is described.

In one embodiment of the present invention, a powder mixture of metal oxide varistor components is pressed to form a disc. The disc is heated to a range of about 1400° C. to about 1500° C. at a rate from about 5° C./min to about 18° C./min and held at about 1400° C. to about 1500° C. for about one to about 4 hours to sinter the disc. The disc is then cooled at less than 4° C./min to room temperature.

The sintered disc is acid etched and coated with a fritted-silver suspension on a selected area on each side of the disc. The coated disc is dried, heated at about 5° C./min to about 18° C./min to a range of about 540° C. to about 820° C. then held at temperature for up to 20 minutes and then slowly cooled at less than 4° C./min to room temperature. Electrical leads are soldered on the fritted-silver coating to form an electroded varistor and the electroded varistor is encapsulated with a resilient epoxy resin to form an encapsulated varistor package.

In another embodiment of the present invention the acid etched sintered disc of the first embodiment is arc sprayed with aluminum to form a coating on each side of the disc followed by a second arc spray coating of copper on top of the aluminum coating. Electrical leads are then soldered to the copper coating to form an electroded varistor and the electroded varistor is encapsulated with a resilient epoxy resin to form an encapsulated varistor package.

DETAILED DESCRIPTION OF THE PREFERRED EMBODIMENTS

Figure 1:
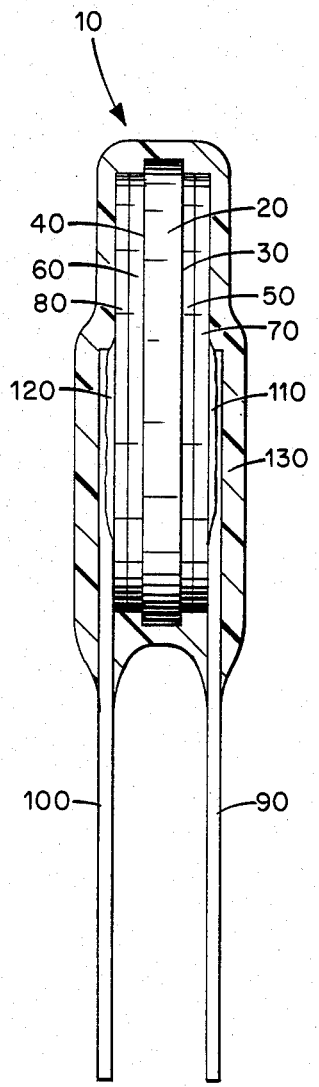
FIG. 1 illustrates an edge view of a varistor package in accordance with one embodiment of the present invention.
Figure 2:
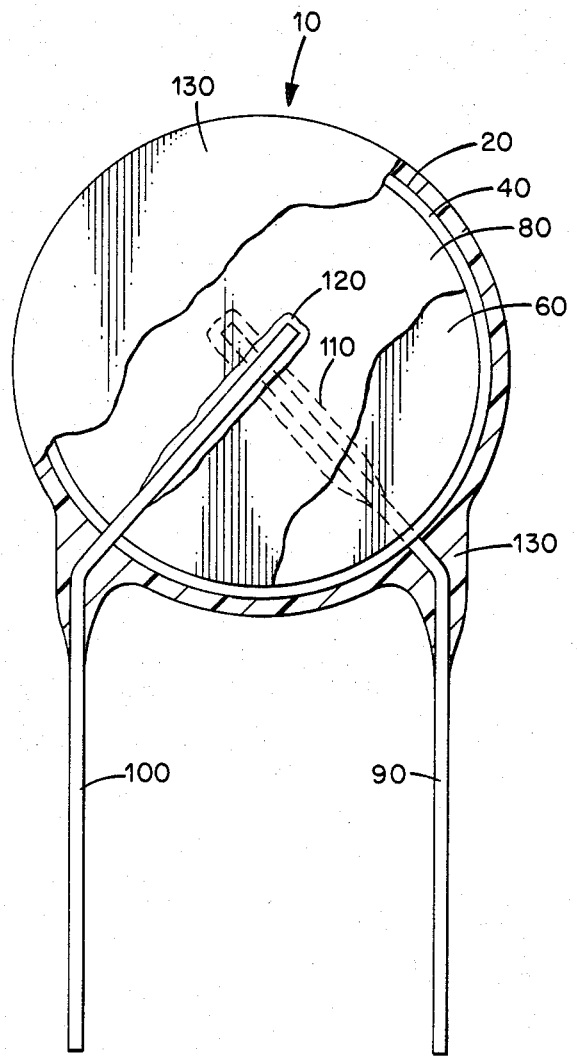
FIG. 2 illustrates a planar view of the varistor package illustrated in FIG. 1.

Referring now to the drawings with greater particularity, there is shown in FIGS. 1 and 2 an encapsulated metal oxide varistor 10.

The encapsulated metal oxide varistor 10 has a metal oxide varistor body 20 having a first side 30 and a second side 40. First electrodes 50 and 60 are coated on the first side 30 and the second side 40 of the varistor body 20 respectively. Second electrodes 70 and 80 are coated on top of first electrodes 50 and 60 respectively. Electrical lead wires 90 and 100 are attached to second electrodes 70 and 80 respectively by solder 110 and 120. The entire varistor package is encapsulated in an epoxy coating 130 to form an encapsulated metal oxide varistor 10.

Figure 3:
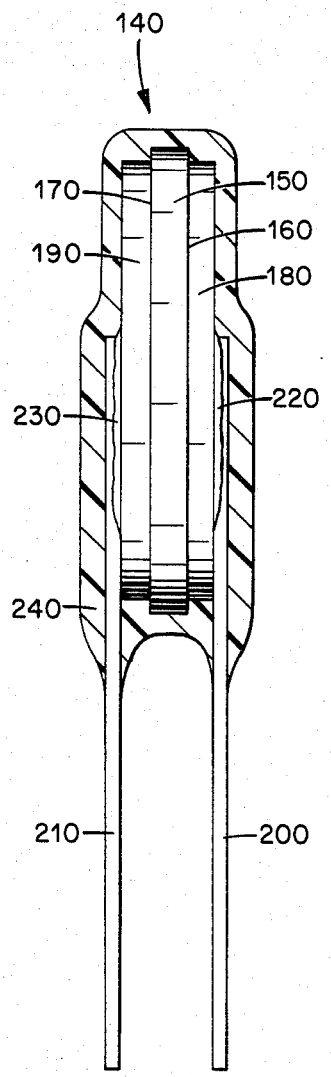
FIG. 3 illustrates an edge view of a varistor package in accordance with another embodiment of the present invention.
Figure 4:
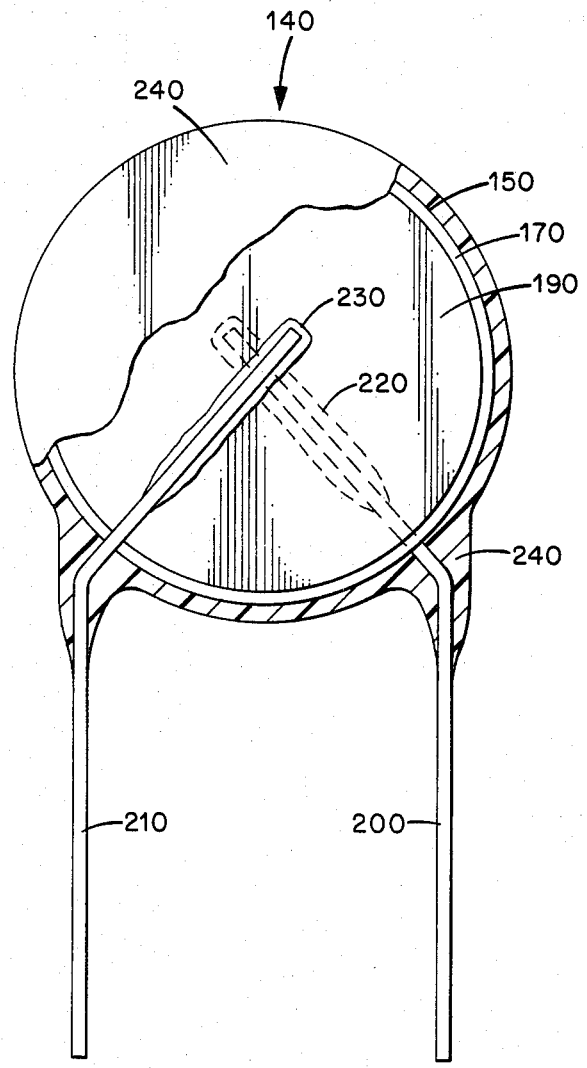
FIG. 4 illustrates a planar view of the varistor package illustrated in FIG. 3.

Shown in FIGS. 3 and 4 is an encapsulated metal oxide varistor 140.

The encapsulated metal oxide varistor 140 has a metal oxide varistor body 150 having a first side 160 and a second side 170. Electrodes 180 and 190 are coated on the first side 160 and the second side 170 of varistor body 150 respectively.

Electrical lead wires 200 and 210 are attached to electrodes 180 and 190 respectively by soldered connections 220 and 230.

The entire varistor package is encapsulated in an epoxy coating 240 to form an encapsulated metal oxide varistor 140.

Packaging Considerations in Varistor Integration

Electrode

The primary considerations in selecting an electrode system were deposition efficiency, adherence to the ZnO-MO substrate and solderability. Two classes of materials received particular attention.

One class consists of fritted-silver conductive coatings available from the Electroscience Laboratories, Inc., Pennsauken, N.J. or from the Dupont Company of Wilmington, Del. These coatings can be deposited in a number of ways, typically by hand painting on a laboratory scale and by silk screening in production. All require a thermal fusion step for adherence to the substrate. Those we investigated had silver contents of from 50 w/o to 70 w/o combined with proprietary frits in organic solvents. The frits ranged in their melting points with recommended peak firing temperatures as low as 540° C. and as high as 850° C. Our final preference is a DuPont 7713 containing 70 w/o silver in a proprietary solvent (DuPont 8250), but it is thermally fused at 660° C. for better adherence; this is above the manufacturer's recommended peak temperature of 540° C. This is then followed by a slow cool (2.5°/min).

The second class of electrodes considered were those which can be deposited by arc spraying. This technique involves the generation of an arc at the junction of two wires of the material to be deposited, and the molten particles so generated are propelled by an air jet stream onto the substrate. The deposition follows the topography of the substrate surface without the generation of any appreciable heat. Of the candidates considered (i.e., Cu, Cu on Al, Al, Zn, Ag, and Cu-Sn phosphor bronzes), our final preference was Cu on Al. The aluminum gives the best adherence of those tested but it is not easily solderable. Therefore, a second deposition of Cu onto the aluminum maintains a good contact and provides a surface on which the subsequent leads could be soldered.

Solder

The solder is more or less dictated by the electrode composition. Pb/Sn solders are readily available and are quite acceptable for the arc sprayed Cu on Al. However, in the case of the fritted-silver electrodes, a 2% silver-bearing Pb/Sn solder is necessary to minimize leaching of the silver from the fritted-silver electrode.

Leads

The leads consist of Sn-coated copper having a diameter of 31 mils (AWG20) (American Wire Gauge). These are commercially available from Die-Craft Metals Product Inc., Des Plaines, Ill.

Epoxy Encapsulant

The principal criteria in the selection of an epoxy resin included thermal shock resistance, resiliency, with minimal compressive stress and high heat capacity. These criteria were considered in order to absorb and/or dissipate heat generated in the varistor applications, to avoid detachment of the electrode from the substrate, to avoid microcracking and to avoid any compressive force that would alter the varistor electrical properties.

Load Dump is one electrical test required for automotive applications (SAE Handbook, Specification No. J1113a on "Electromagnetic Susceptability Procedures for Vehicle Components," paragraph 5, Society of Automotive Engineers, Inc. 1981).

Damages incurred upon Load Dump when an inappropriate epoxy was used as the encapsulant included detachment of the electrode, at least in part, from the varistor substrate. In addition, extensive intergranular and intragranular microcracks developed within the ZnO-MO substrate. The epoxy used in this instance was Polyset EPC-46, obtainable from Morton Chemical, Woodstock, Ill. This epoxy is normally used for the encapsulation of PTC (positive temperature coefficient) devices. Its curing agent chemistry differs from that of our preferred DK28 obtainable from the Hysol Division of the Dexter Corporation of Olean, N.Y. The former is based on a phenolic system while the latter is based on an anhydride system. Because of these differences the EPC-46 is more brittle and less resilient that DK28 and it is far inferior in thermal shock resistance. Despite the fact that it has a lower thermal coefficient of expansion than DK28 (approx. $30\times10^{-6}$ vs approx. $\times10^{-6}$) and closer to that of ZnO (approx. $4\times10^{-6}$), both are sufficiently higher than ZnO that this parameter does not explain the effect observed. DK28 is apparently resilient enough during thermal excursions to prevent damage to the ZnO and this factor alone may account for the differences in damage observed. DK28 has a linear coefficient of thermal expansion of 4 to $7\times10^{-5}$ in/in/°C.

This DK28 epoxy is not known to be used by varistor manufacturers. Our second choice, however, is known to be used by a major varistor manufacturer and is available as KR 544 from the Furane Products Corporation of Hillburn, N.Y. Its curing agent chemistry is that of a modified phenolic system and it also contains a toughening additive. Its thermal expansion is $5.85\times10^{-5}$ in/in/°C. The KR 544 performed as well as the DK28 upon Load Dump. However, it has been learned from the manufacturers that under an AC bias voltage of about 90–95% of the normal breakdown level, and at 125° C., the leakage current of varistors coated with the DK28 increased whereas those coated with the KR 544 did not show this increased conductivity. This test suggests that the KR 544 could be the preferred encapsulant, especially if the varistor is to be subjected to more severe electrical testing. However, we were unable to substantiate this difference. (The KR 544 epoxy is also less rigid and more resilient than the EPC-46 and has a coefficient of expansion of $4.5\times10^{-5}$ in/in/°C.).

Preparation of Sintered Disc

The ZnO powder is added to a mixture of the remaining constituents listed in Table I which are all in solution except for the $TiO_2$ which is used as a colloidal suspension, to form a slurry. The mixture is dried and heated to convert all the constituents to their corresponding oxides.

A 0.68 g portion of the powder obtained from Table I formulation is poured into a ⅝" diameter die, leveled, then placed into a single action press and pressurized to 4600 lb. The pellet formed is then removed and placed into an alumina boat which is put into a vertical furnace for binder bake-out. The furnace is heated to 700° C. in about 1 hour, held at temperature for 2 hours and then shut off. The furnace is allowed to cool to room temperature. The disc is then placed onto an inverted platinum crucible cover which has been covered with a thin layer of grog material (setter sand made by heating ZnO to 900° C. for 1 hr., cooled and sieved to −40+60 mesh) to keep the disc from sticking to the platinum. If other discs are added to make a stack, the grog is sprinkled between each disc to minimize sticking problems. A disc (1–2 grams) of charge material is placed on top of the varistor disc (or stack of discs) that is then covered with an inverted $ZrO_2$ crucible. This assembly of platinum dish, discs, charge disc, and crucible cover is then placed into an alumina boat. The boat is positioned on a "D" tube (that is inside a mullite tube) and slid into the center of a high temperature furnace. The furnace is heated at about 5° C./min to about 18° C./min, preferably 10° C./min. to about 1400° C. to about 1500° C., preferably 1450° C. in air, held for about one to about 4 hours, preferably 2 hours, then cooled at less than 4° C./min, preferably 2.5° C./min, to room temperature. The boat is then withdrawn from the furnace, the crucible is removed and the disc(s) separated from the platinum dish and the charge disc. To clean the disc a single edge razor blade is first used to scrape off grog stuck to the surface. This is followed by ultrasonic cleaning in acetone and twice in methanol (for 1 min. each). The disc(s) are then dried for 10 min. in an air oven at 100° C. Optionally, the disc(s) could be etched prior to cleaning. This is performed in an ultrasonic bath using a 100 ml beaker containing about 50 ml of a 4% $HNO_3$ solution. With the ultrasonic unit operating the disc is submerged in the acid solution for 30 seconds, removed, dipped immediately into a 100 ml beaker containing about 70 ml of deionized water and held for one min. It is then transferred to a 100 ml beaker containing about 30 ml of methanol and held for 1 minute. After removal from the ultrasonic unit, the disc is dried in the air oven at 100° C. for 5 minutes. The varistor is now ready for the deposition of electrodes.

Deposition of Electrodes

An artist's brush is used to spread a conductive coating of a fritted-silver suspension over the surface. Care is taken not to reach the edge of the disc so as to leave an uncoated band approximately 0.03" wide from the edge. The disc is air dried for 15 minutes at room temperature to allow for leveling of the coating. The electroded disc is transferred to the air oven and kept at 100° C. for 30–60 minutes to thoroughly dry the coating. When this is completed, the same process is repeated on the reverse side. After both sides have been coated and dried the disc is placed in an alumina rectangular boat with a piece of alumina thermocouple insulator under one edge to lift it off the bottom of the boat; this avoids contact between the conductive coating and the boat surface. The mullite furnace tube is now replaced with an alumina tube of the same size. The alumina boat containing the sample(s) is placed on the tube "D", slid into the center of the furnace, heated at about 5° C./min to about 18° C./min, preferably 10° C./min to about 540° C. to about 820° C., preferably to about 540° C. to about 760° C., more preferably to 660° C., held for up to 20 minutes, preferably 10 minutes, then cooled at less than 4° C./min, preferably 2.5° C./minute to room temperature.

Alternately an electrode of copper on aluminum is deposited by an arc spray technique. The combined thickness of the Cu on Al arc sprayed electrode averages about 7 mils. To our knowledge this technique is not used for varistor electrodes by other manufacturers. The aluminum is deposited first to provide good adherence to the varistor substrate. Since aluminum is not readily amendable for the subsequent soldering of leads, a coating of copper is arc sprayed onto the aluminum. This combination provides good electrical contact which is solderable and does not necessitate a thermal treatment for its adhesion. However, the best features of both electrode systems are maintained when the thermal cycle normally required for the depostion of the fritted-silver is used is applied before the deposition of the arc sprayed Cu on Al. (i.e. the lower clamping voltage of the arc sprayed electrode with the lower currents of the fritted-silver electrode.) This is considered an important and unexpected benefit.

Soldering of Leads

The attachment of copper leads is the next step in the process. Preshaped leads are clipped onto the electroded varistor and a solder paste is spread around the lead where it contacts the electroded surface. A soldering iron is used to melt the solder paste and thereby form a solder joint between the electrode and the leads. After this is done on both sides the leaded varistor must be cleaned. This is accomplished by placing 3–100 ml beakers in the ultrasonic bath containing a flux cleaner, acetone and methanol, which are used in that order. After the part has been treated approximately one minute in each solution it is put in the air oven at 100° C. for 5 minutes.

Encapsulation

When dry, the part is mounted in a clamp on a fluidized bed coating machine, then alternately held in a heating unit and the fluidized bed of epoxy powder to give a coating thickness of 0.030" to 0.040". At this point the epoxy is soft and great care must be taken to avoid contact with any other object. The epoxied varistor is then placed on hangers in an air oven for 75 minutes at 150° C. to cure the epoxy. After the epoxy is cured and cooled the varistor is removed, the leads are cut to length, shaped as desired and the part labeled.

TABLE I

| Constituent | Weight percent of the constituent calculated as the oxide |
|---|---|
| Zinc Oxide ZnO | 92.434 |
| Bismuth Nitrate $Bi(NO_3)_3.5H_2O$ | 3.90 |
| Nickel(ous) Nitrate $Ni(NO_3)_2.6H_2O$ | 0.24 |
| Cobalt Nitrate $Co(NO_3)_2.6H_2O$ | 1.10 |
| Chromium Nitrate $Cr(NO_3)_3.9H_2O$ | 0.14 |
| Aluminum Nitrate $Al(NO_3)_3.9H_2O$ | 0.0045 |
| Boric Acid $H_3BO_3$ | 0.123 |
| Lead Acetate | 0.34 |

TABLE I-continued

| Constituent | Weight percent of the constituent calculated as the oxide |
|---|---|
| $Pb(C_2H_3O_2)_2.3H_2O$ | |
| Potassium Acetate $KC_2H_3O_2$ | 0.008 |
| Manganese Acetate $Mn(C_2H_3O_2)_2.4H_2O$ | 0.80 |
| Antimony Trichloride $SbCl_3$ | 0.11 |
| Titanium Oxide $TiO_2$ | 0.80 |

While there has been shown and described what is at present considered the preferred embodiment of the invention, it will be obvious to those skilled in the art that various changes and modifications may be made therein without departing from the scope of the invention as defined by the appended claims.

What is claimed is:

1. A method of making an encapsulated varistor package comprising the steps:

Step 1—pressing a varistor powder mixture to form a pressed body, said pressed body having a first and a second side;

Step 2—heating the product from step 1 to a range of about 1400° C. to about 1500° C. at about 5° C./min to about 18° C./min;

Step 3—maintaining the product of step 2 at about 1400° C. to about 1500° C. for about one to about 4 hours;

Step 4—cooling the product of step 3 at less than 4° C./min to room temperature;

Step 5—acid etching the product from step 4;

Step 6—coating the product from step 5 with a fritted-silver suspension on selected areas on said first and second sides;

Step 7—heating the product from step 6 to a range of about 540° C. to about 820° C. at about 5° C./min to about 10° C./min;

Step 8—maintaining the product of step 7 at about 540° C. to about 820° C. for up to 20 minutes;

Step 9—cooling the product of step 8 at less than 4° C./min to room temperature;

Step 10—soldering electrical leads on said first side and on said second side of the product of step 9; and Step 11—encapsulating the product of step 10 with a resilient epoxy resin to form an encapsulated varistor package.

2. A method of making an encapsulated varistor package comprising the steps:

Step 1—pressing a varistor powder mixture to form a pressed body, said pressed body having a first and a second side;

Step 2—heating the product from step 1 to a range of about 1400° C. to about 1500° C. at about 5° C./min to about 18° C./min;

Step 3—maintaining the product of step 2 at about 1400° C. to about 1500° C. for about one to about 4 hours;

Step 4—cooling the product of step 3 at less than 4° C./min to room temperature;

Step 5—acid etching the product from step 4;

Step 6—arc spray coating the product from step 5 with aluminum on selected areas on said first side and on said second side of said product;

Step 7—arc spray coating copper on top of the aluminum coating from step 6;

Step 8—soldering an electrical lead on the copper coated said first side and on the copper coated said second side of the product of step 7; and Step 9—encapsulating the product of step 8 with a resilient epoxy resin to form an encapsulated varistor package.

* * * * *